US007343958B1

(12) United States Patent
East et al.

(10) Patent No.: US 7,343,958 B1
(45) Date of Patent: Mar. 18, 2008

(54) OVERHEAD DOOR LIFT SYSTEM

(75) Inventors: A. Anthony East, East Bend, NC (US); Darrin Brunk, Lawrence, KS (US); Yannick Funk, Drummondville (CA); Normand Savard, Drummondville (CA); Mathieu Provencal, St. Dares de Brompton (CA)

(73) Assignee: Amarr Company, Winston-Salem, NC (US)

( * ) Notice: Subject to any disclaimer, the term of this patent is extended or adjusted under 35 U.S.C. 154(b) by 155 days.

(21) Appl. No.: 11/098,187

(22) Filed: Apr. 4, 2005

(51) Int. Cl.
*E05F 11/04* (2006.01)

(52) U.S. Cl. ..... 160/191; 16/401; 242/602.1

(58) Field of Classification Search ..... 160/191, 160/192, 190, 189, 201, 193, 188; 16/198, 16/401; 49/200; 242/602.1, 613.1
See application file for complete search history.

(56) References Cited

U.S. PATENT DOCUMENTS

| | | | | | |
|---|---|---|---|---|---|
| 2,007,552 | A | * | 7/1935 | Vetterlein | 160/193 |
| 2,314,015 | A | * | 3/1943 | Parsons | 16/198 |
| 2,680,004 | A | * | 6/1954 | Herker | 254/340 |
| 2,722,273 | A | * | 11/1955 | Taylor | 160/191 |
| 2,855,162 | A | * | 10/1958 | Schacht, Jr. | 242/587.1 |
| 3,095,922 | A | * | 7/1963 | Frazier | 160/191 |
| 3,311,159 | A | * | 3/1967 | Stansberry | 160/189 |
| 3,756,585 | A | | 9/1973 | Mihalcheon | |
| 4,034,932 | A | | 7/1977 | Ferch | |
| 4,071,205 | A | | 1/1978 | Wieschel | |
| 4,165,053 | A | | 8/1979 | Konig | |
| 4,483,496 | A | | 11/1984 | Weinlich | |
| 4,519,556 | A | | 5/1985 | Timoschuk | |
| 4,882,806 | A | | 11/1989 | Davis | |
| 5,103,890 | A | | 4/1992 | Cloutier | |
| 5,239,777 | A | | 8/1993 | Husselton | |
| 5,259,433 | A | * | 11/1993 | Cloutier | 160/190 |
| 5,335,883 | A | | 8/1994 | Mawer | |
| 5,400,721 | A | | 3/1995 | Greene | |
| 5,803,149 | A | | 9/1998 | Halley et al. | |
| 5,829,736 | A | | 11/1998 | Harken | |
| 5,829,737 | A | | 11/1998 | Gersemsky | |
| 5,865,235 | A | | 2/1999 | Krupke et al. | |
| 6,019,353 | A | | 2/2000 | Atfield | |
| 6,134,835 | A | | 10/2000 | Krupke et al. | |
| 6,164,014 | A | | 12/2000 | McDowell et al. | |
| 6,374,543 | B1 | | 4/2002 | Bishai | |
| 6,401,793 | B1 | | 6/2002 | Martin | |
| 6,408,925 | B1 | | 6/2002 | Dorma | |
| 6,442,897 | B1 | | 9/2002 | Mullet | |
| 6,561,256 | B2 | | 5/2003 | Mullet | |
| 6,601,794 | B2 | | 8/2003 | Brutschin | |
| 6,616,091 | B2 | | 9/2003 | Priest et al. | |
| 2002/0066231 | A1 | | 6/2002 | Hormann | |
| 2002/0157797 | A1 | | 10/2002 | Mullet | |
| 2003/0062441 | A1 | | 4/2003 | Priest et al. | |
| 2003/0192254 | A1 | | 10/2003 | Brookbank et al. | |

* cited by examiner

*Primary Examiner*—Blair M. Johnson
(74) *Attorney, Agent, or Firm*—Womble Carlyle Sandridge & Rice, PLLC

(57) ABSTRACT

A garage door cable drum is disclosed for a sectional overhead door of a type having a substantially non-linear lift-weight to lift-height characteristic. The drum includes a generally spiral cable groove having a variable minor radius. The groove minor radius at any intermediate point along the groove is sized to provide a lift-cable moment arm that yields a corresponding cable lift force that is slightly less than an instantaneous lift weight of the garage door at any intermediate door elevation.

9 Claims, 10 Drawing Sheets

{PRIOR ART}

OVERHEAD DOOR LIFT SYSTEM

FIELD OF THE INVENTION

The invention relates to counterbalancing lift systems for overhead doors such as overhead garage doors. More particularly, the invention relates to an overhead door lift system that substantially maintains the upward force required to lift an overhead door having a non-linear relationship between free door weight and door elevation.

BACKGROUND

Overhead doors provide convenient and effective closures for large entrance openings such as entranceways to residential garages. One conventional sectional overhead door assembly 13 is shown in FIG. 1. A typical modern overhead garage door 13 includes a plurality of horizontal door sections 12 pivotally connected together by hinges 15. Rollers 14 on ends of the door sections 12 ride in pairs of roller tracks or rails 40, 42. Each roller track 40, 42 typically includes a vertical portion 44, 46, a horizontal portion 48, 50, and a curved transition portion 52, 54 connecting the vertical 44, 46 and horizontal portions 48, 50. The vertical portions 44, 46 of these roller tracks 40, 42 are mounted along opposed vertical edges of the garage entranceways 60. At or near the top of the entranceway 60, the curved portions 52, 54 of the tracks 40, 42 curve inwardly into the enclosed space. Substantially horizontal portions 48, 50 of the tracks 40, 42 extend into the garage at or near the elevation of the top of the entranceway 60. In a closed position like that shown in FIG. 1, the rollers 14 on the door sections 12 are supported in the vertical portions of the roller tracks, thereby supporting the door such that the door spans and covers the entranceway 60. A latching/locking mechanism may secure the door 13 against upward movement (not shown).

A typical sectional overhead door 13 is opened by raising the door sections 12 along the roller tracks 40, 42. As the door sections 12 are raised, the rollers 14 travel along the vertical track portions 44, 46, enter and travel along the curved track portions 52, 54, and finally enter and travel along the horizontal track portions 48, 50. Accordingly, the pivotally-connected door sections 12 are moved from a vertical, closed orientation, to a substantially horizontal, open orientation. When fully open, the door is positioned entirely within the garage space at or above the topmost elevation of the doorway 60. To close the door 13, the door sections 12 are guided by the tracks 40, 42 to a closed, vertical orientation.

As a sectional overhead door is lifted and the rollers enter the horizontal portion of the roller tracks, the weight of the door progressively is carried by the horizontal portions of the tracks. For example, for a five-panel sectional overhead door like that shown in FIG. 1, once the rollers 14 on the uppermost door panel 12 engage the horizontal portions 48, 50 of the roller tracks 40, 42, the weight of the engaged uppermost panel 12 is supported by the tracks 40, 50. Accordingly, the total force required to further lift the other four door panels 12 is about 80 percent of the total weight of the door 13. Once the door 13 is fully open, substantially the entire weight of the door 13 is carried by the tracks 40, 50.

The externally applied upward force "F" required to incrementally lift a typical sectional overhead door is at or near a maximum force "$F_{max}$" when the door is in a closed, fully downward position. In this fully downward position, the elevation "h" of the bottom edge of the door above the floor is at a minimum elevation "$h_{min}$." Conversely, the applied force F required to incrementally lift a typical sectional overhead door is at a minimum force "$F_{min}$" as the door approaches its open, fully upward position. In this fully upward position, the elevation "h" of the bottom edge of the door above floor level is at a maximum elevation "$h_{max}$." Because conventional sectional overhead doors have substantially uniform cross-sections, the incremental applied lift force F required to lift such a door is substantially inversely linearly proportional to the elevation "h" of the bottom edge of the door above floor level. Accordingly, the applied lift force F required to incrementally lift a sectional overhead door having a maximum incremental lift force $F_{max}$ and minimum incremental lift force $F_{min}$ between a fully down position ($h=h_{min}=0$) and a fully up position ($h=h_{max}$) can be expressed as:

$$F=h[-(F_{max}-F_{min})/h_{max})]+F_{max}$$

A typical inversely linear relationship between the required upward lift force F and the instantaneous door elevation "h" for a conventional sectional overhead door is graphically depicted in FIG. 2.

Sectional overhead door panels typically are constructed of durable materials such as steel, wood, or the like. Accordingly, multi-panel overhead doors that include such panels are heavy to lift. For example, a typical sectional overhead door that is substantially constructed of steel sheet material may weigh 100 pounds or more. Without mechanical assistance, a single person may have difficulty or may be unable to manually lift such a door. Therefore, it is common to provide overhead door lifting systems that mechanically apply lifting forces to the doors such that the weights of the doors are substantially counterbalanced by the lifting systems. By applying counterbalancing lift forces that are slightly less than the free hanging weights of the doors (for example, 5-10 pounds less), the lifting systems permit the doors to be manually lifted with only minimal additional applied lifting force. Accordingly, such lift-assisted doors can be easily raised by a single person or by a conventional automatic door opener.

A typical sectional overhead door lifting system 10 is shown in FIG. 1. The lifting system 10 includes a torsion rod 34 rotatably mounted above the entranceway 60 and the sectional overhead door 13 by one or more mounting brackets 23, 27, 30. One or more coil torsion springs 36 are positioned on the torsion rod 34, and are fixed at one end to the torsion rod 34 by winding cones 60, and at an opposite end to a fixed bracket 30 by anchor cones 11. A cable drum 24, 26 is affixed to each end of the torsion rod 34. A cable 20 is wound on each cable drum 24, 26. Lower ends of the cables 20 are affixed to the lower end of the door 13 by cable brackets 22. When the door 13 is in a fully upward, open position, the coil torsion springs 50 are substantially unwound and apply substantially zero torsional load to the torsion rod 34 and cable drums 24, 26. Accordingly, in this fully upward, open position, the tensile load on the lift cables 20 is substantially zero. As the door 13 is lowered, however, the cables 20 are partially unwound from the cable drums 24, 26, thereby causing the drums 24, 26 and torsion rod 34 to rotate relative to the fixed bracket 30. As the torsion rod 34 rotates, the torsion spring 36 is wound and tightens, thereby creating tension in the cables 20. Accordingly, the tension in the cables 20 increases as the door 13 is lowered, thereby applying an increasing upward force to the door 13. The maximum torsional load in the torsion spring 36, maximum tension in the cables 20, and maximum resultant upward-acting force on the door 13 occurs when the door 13 is in a closed, fully downward position. Conversely, the minimum torsional load in the torsion spring 36, minimum tension in the cables 20, and minimum resultant upward-acting force on the door 13 occurs when the door 13 is in a closed, fully downward position. Typically, such torsion springs 36 have substantially linear spring constants.

In such conventional door lift systems 10, the cable drums 24, 26 have a substantially constant diameter. As shown in FIG. 3, a typical cable drum 24, 26 includes a drum cylinder 80 having a spiral cable groove 82 therearound. The cable groove 82 has a substantially constant minor radius "$r_m$". The term "minor radius" as used herein is the radial distance from the cable drum centerline to the root of the spiral groove at a point along the length of the spiral groove. As the a door is raised or lowered, a cable 20 is wound onto or unwound from the cable groove 82. In a conventional overhead door lift system 10, the constant-diameter drum 24, 26 and coil torsion spring 36 cooperate to provide tension in the cables 20 that is substantially inversely linearly proportional to the elevation of the bottom of the door 13 from the floor. Desirably, the lift system 10 is configured such that the upward lift force applied to the door 13 by the cables 20 is only slightly less than the free-hanging weight of the door 13 at any point along the upward or downward movement of the door 13. Accordingly, the linearly variable upward lift force applied by the lift system 10 is effective to substantially counterbalance a majority of the downwardly acting, substantially linearly variable weight of the door 13 (like that depicted in FIG. 2). A properly designed lift system 10 permits a sectional overhead door 13 to be easily lifted by applying a substantially constant, upward manual force of only about 5-10 pounds, and more preferably about 5 pounds. Such a properly balanced system 10 prevents a rising door 13 from surging upward due to excessive counterbalancing lift forces, permits a door 13 to be slightly biased toward a closed position by the door's own weight, and prevents a closing door 13 from slamming shut due to insufficient counterbalancing lift forces. Such a system 10 also permits a typical sectional door 13 to be operated by a conventional automatic door opener.

Because upward-acting sectional overhead doors have large surface areas, such doors can be vulnerable to high static or dynamic wind loads. Many modern international, state, and local building codes currently require upward-acting doors such as residential overhead garage doors to be capable of withstanding high transverse wind loadings such as those that may be experienced during hurricanes or other storms. For example, many building codes in wind-prone locales require overhead garage doors in newly constructed residential structures to comply with wind-load testing standards such as ASTM E 330-97. In order to comply with such regulations, overhead garage door manufacturers have developed reinforcement systems to bolster the strength and stiffness of sheet metal overhead garage doors. As shown in FIG. 4, such reinforcement systems may include reinforcement struts 102 horizontally mounted across the back sides of the thin-walled door panels 104 of a sectional overhead door 100 with suitable fasteners 106 or the like. Such reinforcement struts 102 may be channels, tubes, T-shaped members, U-shaped members, or any other strut configuration having sufficient strength and stiffness.

Though such reinforcement struts 102 have proven to be highly effective in strengthening overhead doors 100 to withstand high transverse wind loads, these struts 102 also change the substantially linear weight-to-height door characteristic described above for doors with substantially uniform cross-sections and without reinforcement struts. A representation of a weight-to-height characteristic for a typical strut-reinforced door 100 is shown in FIG. 4. As can be seen by comparing FIG. 4 to FIG. 2, the addition of reinforcement struts 102 to a sectional overhead door 100 causes the weight-to-height characteristic of the door 100 to change from a substantially linear relationship to a distinctly non-linear relationship. This change primarily is attributable to the non-linear weight distribution between the top and bottom of the strut-reinforced door 100.

Conventional sectional overhead garage doors typically include four or more pivotally connected door sections. Some newer sectional overhead door designs, however, may include only three door sections, such as the overhead doors described in co-pending U.S. patent application Ser. No. 10/699,749, filed Nov. 3, 2003. Such three-section doors tend to have a height-to-weight relationship that is substantially non-linear when compared to the substantially linear height-to-weight relationship for four-panel doors. Especially when such three-panel doors are provided with one or more reinforcement struts like those described above, a substantially nonlinear door height/weight relationship like that shown in FIG. 5 results.

Known substantially linear garage door lift systems like those described above are incapable of providing variable upward-acting forces to adequately counterbalance the non-linear change in door weight associated with changes in door elevation for wind-resistant, strut-reinforced doors overhead doors and/or doors comprised of three sections. Accordingly, there is a need for a door lift system that accommodates this non-linear variability in door lift forces such that a substantially constant applied vertical load is sufficient to raise such a door.

SUMMARY

The present invention includes a counterbalance mechanism for a sectional overhead door of a type having a substantially non-linear lift-weight to lift-height characteristic. The mechanism is capable of applying different counterbalancing lift forces to the door at different intermediate door positions between a fully closed position and a fully open position. The difference between an intermediate lift weight of the door and a corresponding counterbalancing lift force at any intermediate door position is substantially constant.

The invention also includes a garage door cable drum for a sectional overhead door of a type having a substantially non-linear lift-weight to lift-height characteristic. The drum includes a generally spiral cable groove having a variable minor radius. The groove minor radius at any intermediate point along the groove is sized to provide a lift-cable moment arm that yields a corresponding cable lift force that is slightly less than an instantaneous lift weight of the garage door at any intermediate door elevation.

The invention further includes a counterbalance mechanism for a sectional overhead door having a maximum lift weight and a non-linear lift-weight to lift-height characteristic, wherein the mechanism applies a maximum counterbalancing lift force to the door when the door is in a fully closed position and applies a minimum counterbalancing lift force to the door when the door is in a fully open position. The mechanism is configured to apply variable intermediate counterbalancing lift forces to the door when the door is raised to intermediate elevations between the fully open and fully closed positions. The difference between an applied counterbalancing lift force and a corresponding intermediate lift weight of the door at any intermediate lift position is substantially equal to the difference between the maximum suspended weight of the door and the maximum lift load.

The invention also includes a cable winding drum comprising a drum body having a longitudinal axis and a generally spiral cable groove therearound. The cable groove includes a plurality of successive turns around the drum body. Each of the turns includes at least one groove radius that is larger than at least one other groove radius of each adjacent turn.

The invention further includes a cable winding drum that includes a body having a longitudinal axis, a first end, a second end, and a substantially continuous cable groove. The groove generally spirally extends around the body from the first end to the second end in a plurality of successive turns. The cable groove is characterized by substantially continuously varying groove radii along its length from the first end to the second end of the drum, the groove radii being measured from the longitudinal axis of the body to points along a bottom of the groove, wherein a first minor radius at a first location between the first and second ends is larger than a second minor radius at a second location between the first location and the first end, and wherein the first minor radius at the first location is larger than a third minor radius at a third location between the first location and the second end.

These and other aspects of the invention can be better understood from a reading of the following detailed description together with the drawings.

DETAILED DESCRIPTION

Figure 6:
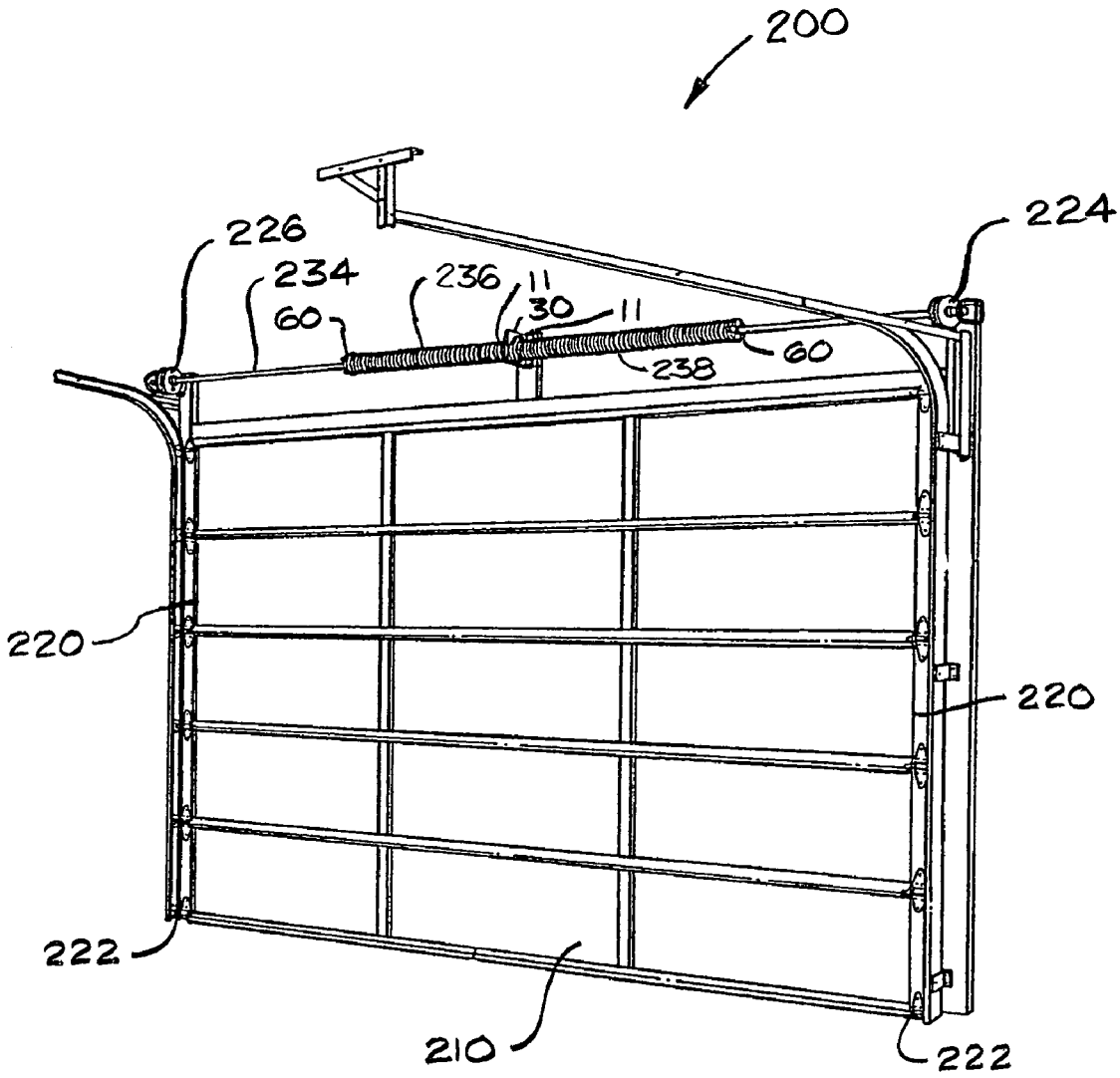
FIG. 6 is an inside perspective view of one embodiment of a door lift system according to the invention.

A door lift system 200 according to the invention is shown in FIG. 6. The system 200 includes a rotatably-mounted torsion rod 234, a pair of coil torsion springs 236, 238, a pair of load-adjusting cable drums 224, 226, and a pair of lift cables 220. The coil torsion springs 236, 238 are connected to the torsion rod 234 at one end by winding cones 60, and are connected to a fixed mounting bracket 30 at the opposite end by anchor cones 11. An upper end of each cable 220 is anchored to and wound upon a respective cable drum 224, 226. The lower ends of the cables 220 are attached to the lower end of a sectional overhead door 210 by suitable cable brackets 222 or the like. In the closed position shown in FIG. 6, the torsion springs 236, 238 are at least partially tightened such that the cables 220 are in tension. Preferably, the torsion springs 236, 238 and cable drums 224, 226 are configured such that the tension in the two cables 220 is substantially equal, and such that the tension in the cables 220 is slightly less than the tension required to cause the door 210 to lift from the closed position. Preferably, the tension in the cables 220 when the door 210 is in a closed position is about 5-10 pounds less than that required to overcome the hanging weight of the door 210 and to cause the door to rise. Most preferably, the tension in the cables 220 when the door 210 is in a closed position is about 5 pounds less than that required to overcome the hanging weight of the door 210 and to cause the door to rise.

Figure 7:
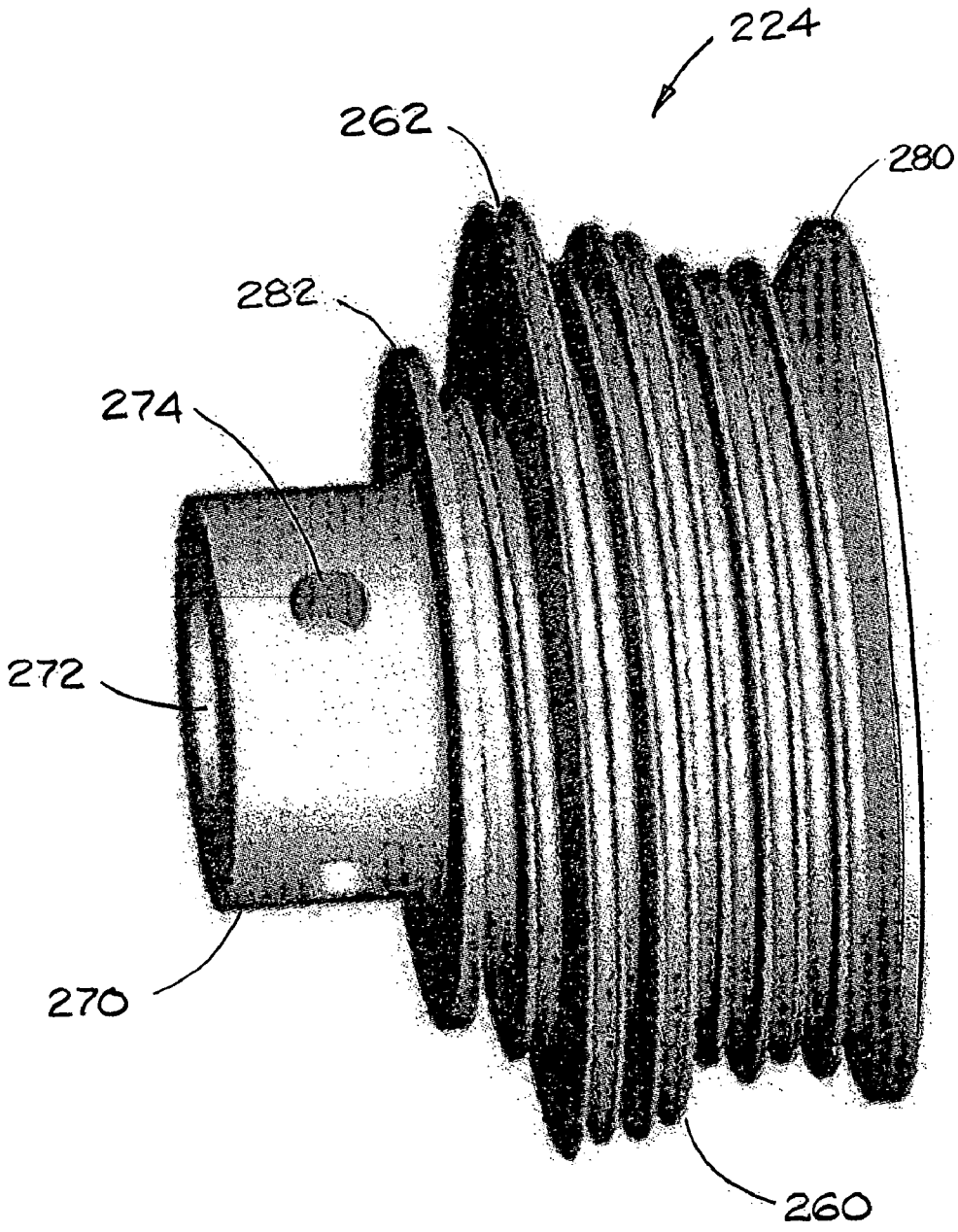
FIG. 7 is a perspective view of one embodiment of a cable drum for a door lift system according to the invention.
Figure 8:
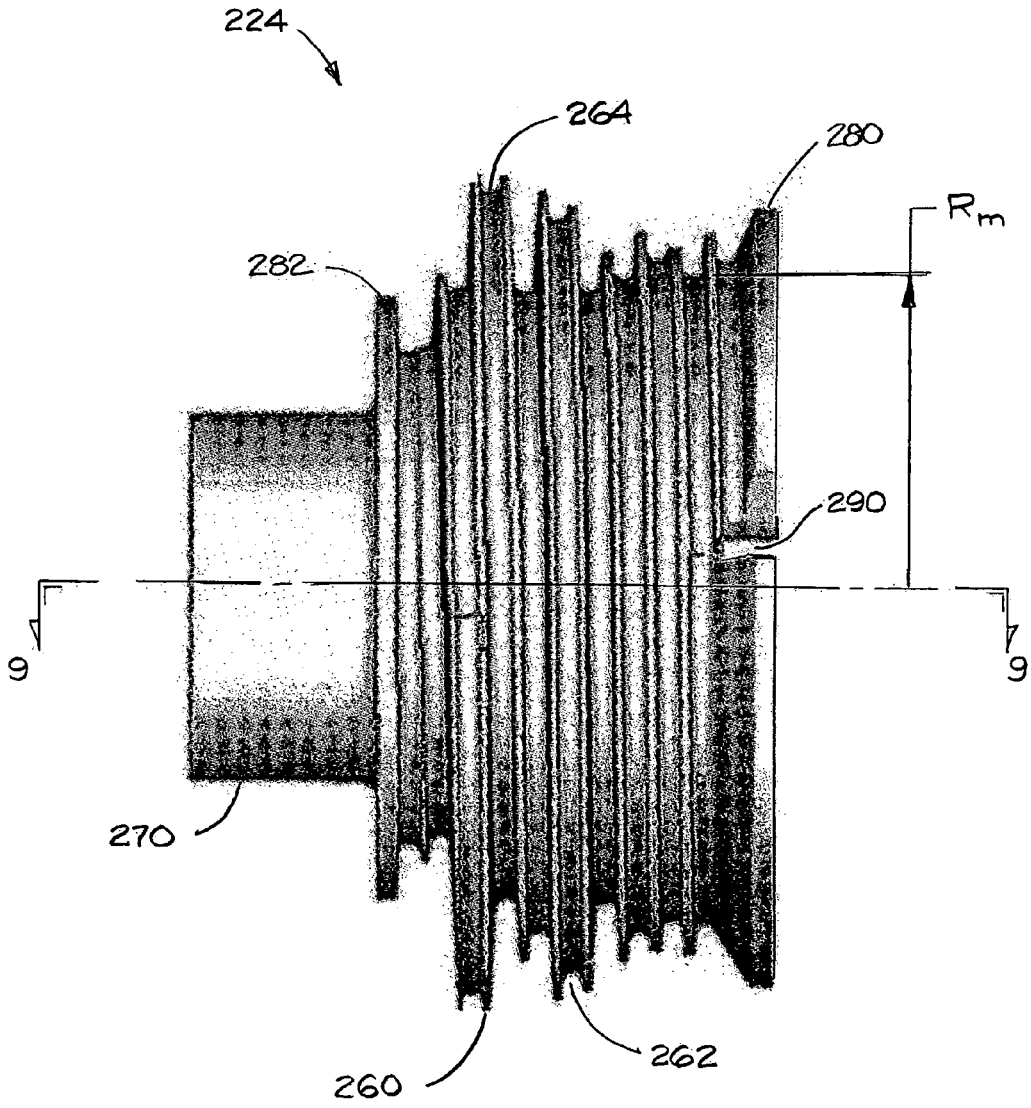
FIG. 8 is an elevation view of the embodiment of a cable drum shown in FIG. 7.
Figure 9:
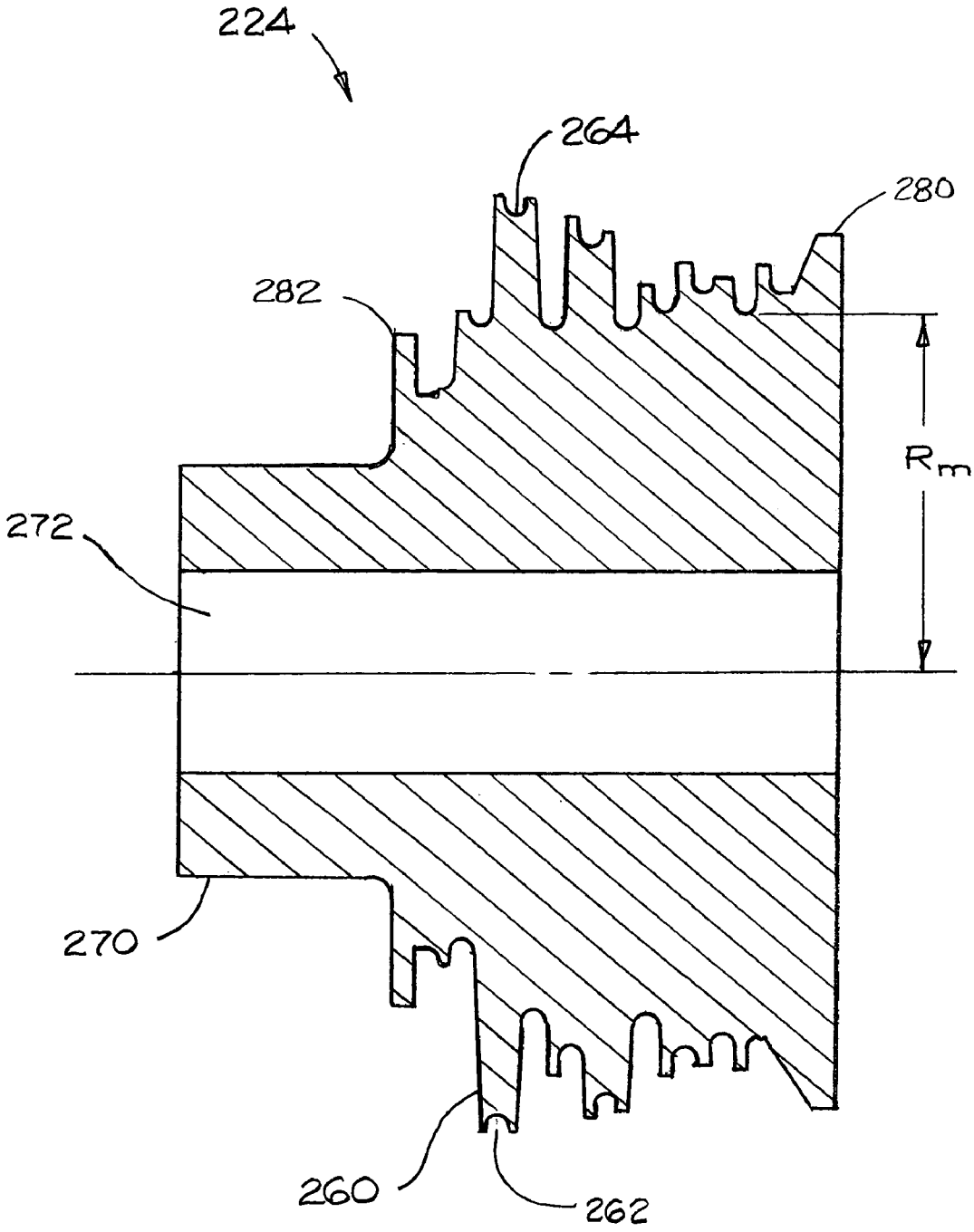
FIG. 9 is a cross-sectional view of the embodiment of the cable drum shown in FIGS. 7 and 8, taken along line 9-9 in FIG. 8.

Details of a right-end cable drum 224 are shown in FIGS. 7-9. The left-end cable drum 226 is a mirror image of the right-end drum 224, but is otherwise substantially identical to the right-end drum 224 shown. As shown in FIG. 7, the drum 224 includes a reel portion 260 and a hub portion 270. A bore 272 extends through the drum 224 and is sized to receive the torsion rod 234. One or more internally-threaded set-screw openings 274 may be provided in the hub portion 270 for receiving set screws (not shown) for securing the drum 224 on the torsion rod 234.

As shown in FIGS. 7-9, the reel portion 260 of the drum 224 includes a generally spiral groove 262 therearound between two flanges 280, 282. The generally spiral groove 262 is sized to receive and align the cable 220 on the drum 224 without binding such that the cable 220 can be freely wound onto the drum 224, and freely unwound from the drum 224. As shown in FIG. 8, a cable anchor slot 290 may be provided in the flange 280 for anchoring an end of the cable 220 to the drum 224. Alternatively, other anchoring means such as a set screw or the like may be provided for securing one end of the cable 220 to the drum 224. Preferably, the root 264 of the spiral groove 262 has a rounded shape similar to that shown in FIGS. 8 and 9 that corresponds to the substantially round cross-sectional shape of a typical wire lift cable 220. As shown in FIGS. 8 and 9, the minor radius $R_m$ of the spiral groove 262 varies substantially continuously along the length of the groove 262. The function and significance of this variation in the minor radius $R_m$ of the groove 262 is explained below.

Figure 10:
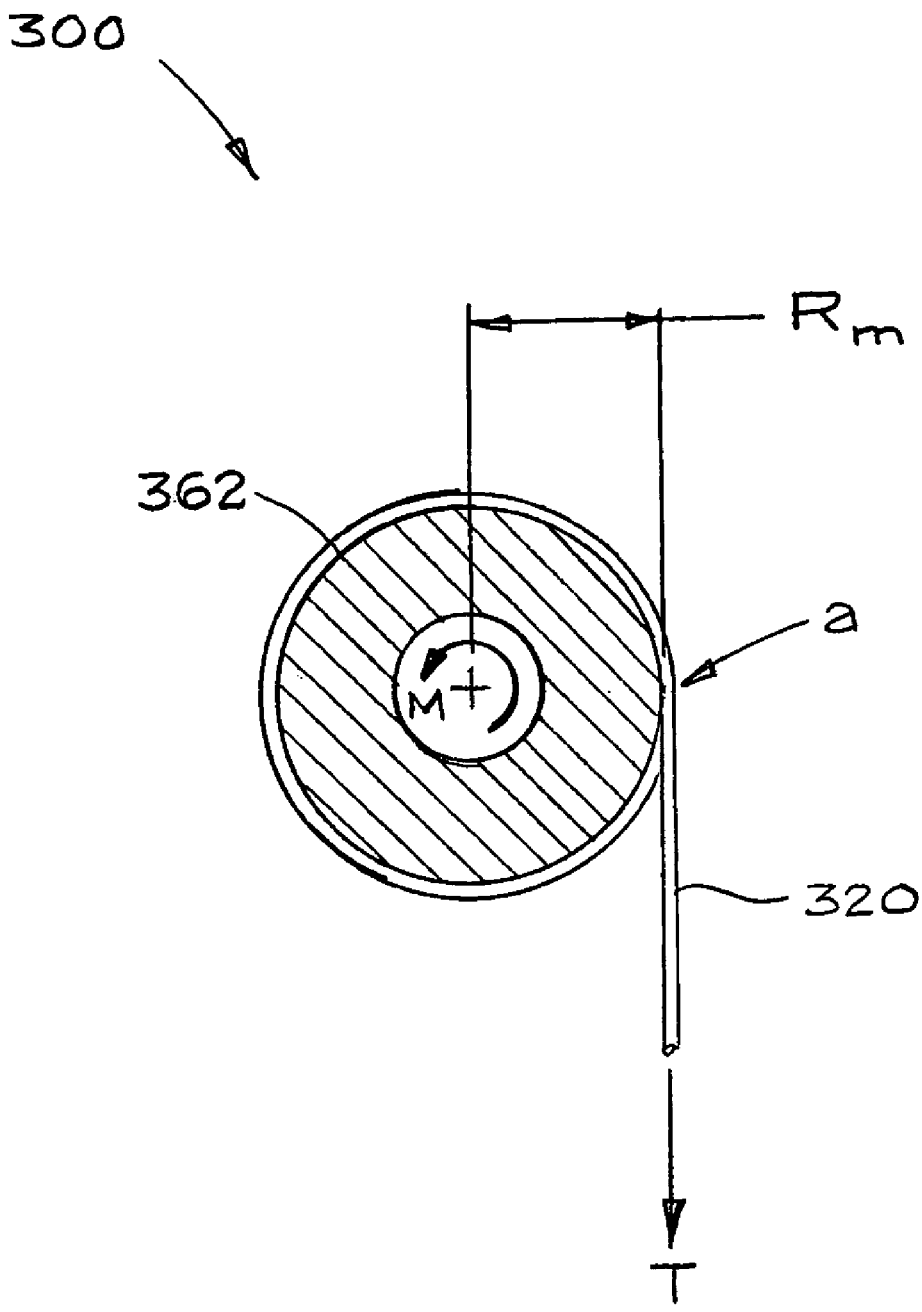
FIG. 10 is a diagram showing the effect of the cable drum groove minor radius on cable tension.

FIG. 10 schematically shows a cable drum 300 having a cable groove 362 with a constant minor radius $R_m$. A cable 320 is wound in the groove 362 and downwardly extends from the drum 300. A torsional load "M" is applied to the cable drum 300 about the drum's axis of rotation in a direction acting to wind the downwardly extending portion of the cable 320 on the drum. The cable 320 experiences a tensile load "T". In equilibrium, the tensile load in the cable 320 may be expressed as follows:

$$T=M/R_m$$

Accordingly, for a given applied torsional load M, the resultant tension T in the cable 320 is inversely proportional to the minor radius $R_m$ of the drum (i.e., the effective moment arm) at the point "a" where the cable 320 leaves the winding drum 300. In other words, for a given applied torque M, the larger the minor radius of the drum, the smaller the tension T in the cable 320. Conversely, for a given applied torque M, the larger the minor radius of the drum, the smaller the tension T in the cable 320.

In the embodiment of the cable drum 200 shown in FIGS. 7-9, the minor radius $R_m$ of the spiral groove 262 is varied such that when a given torque "$M_0$" is applied to the drum 224 by the torsion spring 236, and the minor radius of the groove 262 at the point the cable 220 departs the drum 200 is $R_1$, the resultant tension $T_1$ in the cable 220 is equal to $M_0/R_1$. Alternatively, if the minor radius of the groove 262 at the point the cable 220 departs the drum 200 is $R_2$, the resultant tension $T_2$ in the cable 220 is equal to $M_0/R_2$. Accordingly, by selectively varying the minor radius of the spiral groove 262 at points along the groove's length, a desired tensile load in the cable 220 can be established based upon a known torsional load on the drum 200 at a known rotational position of the drum 200. Because the torque applied by a coil torsion spring 236 generally is substantially linearly proportional to the amount of angular rotation of the rotating end of the spring 236, one can determine the torsional load M applied to the drum by the spring 236 in a particular state of angular rotation of the torsion bar 234 and drum 224. In addition, one can determine the corresponding minor radius $R_m$ of the groove 262 that is required to produce a desired degree of tension in the cable 220 at a particular rotational position of the drum 224.

Figure 1:
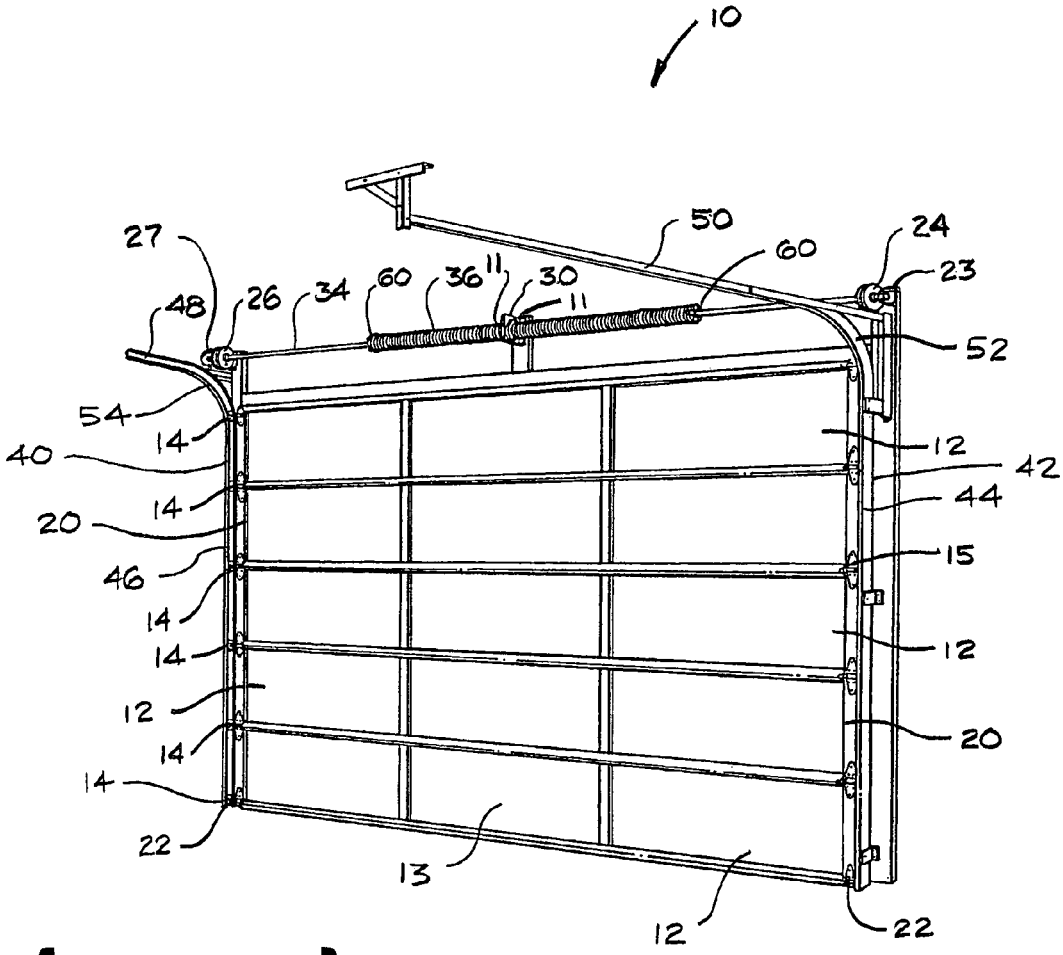
FIG. 1 is an inside perspective view of a conventional overhead sectional door and door lift system.
Figure 2:
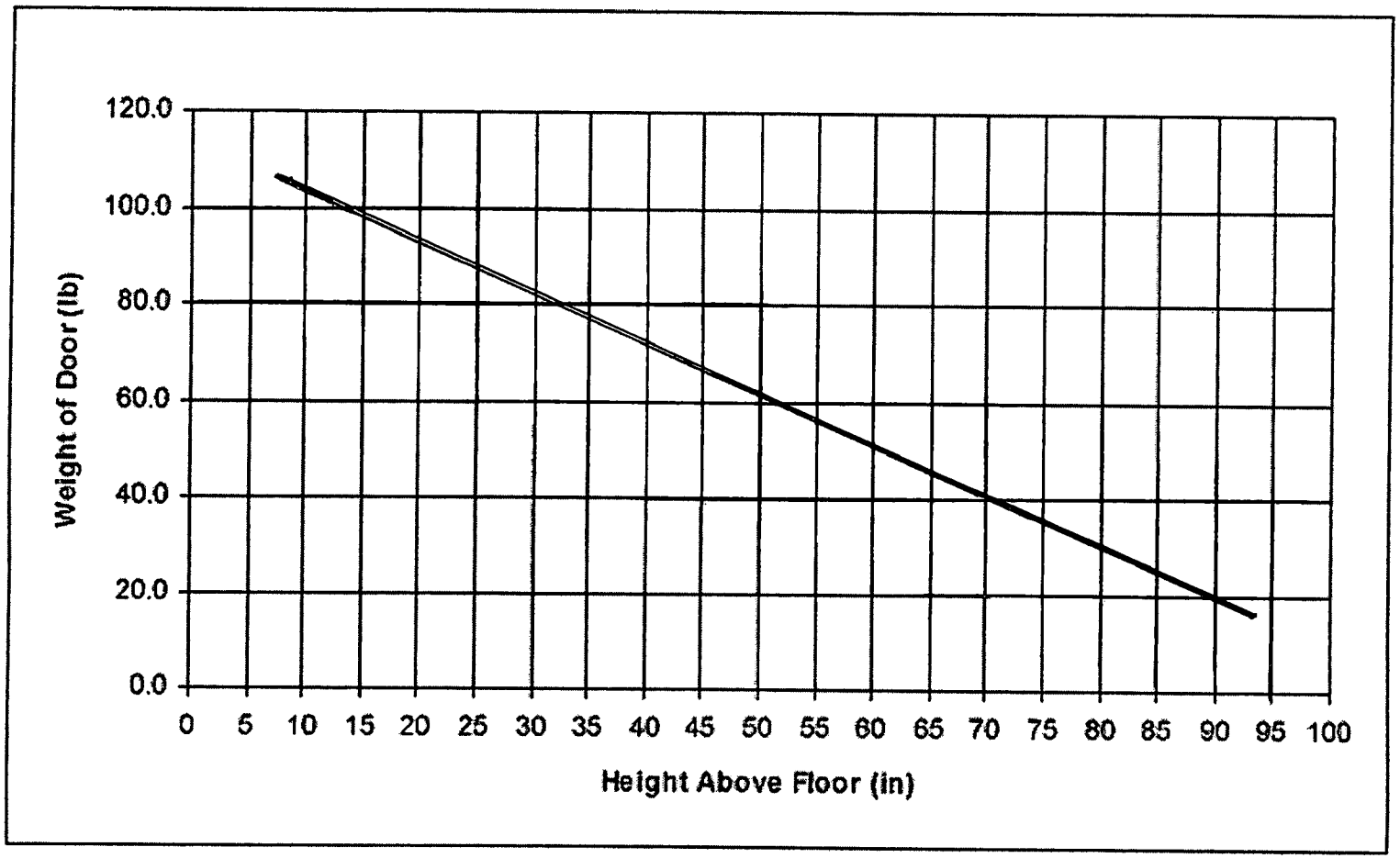
FIG. 2 is a graph showing a typical linear lift-weight to lift-height characteristic of a conventional non-reinforced sectional overhead door.
Figure 3:
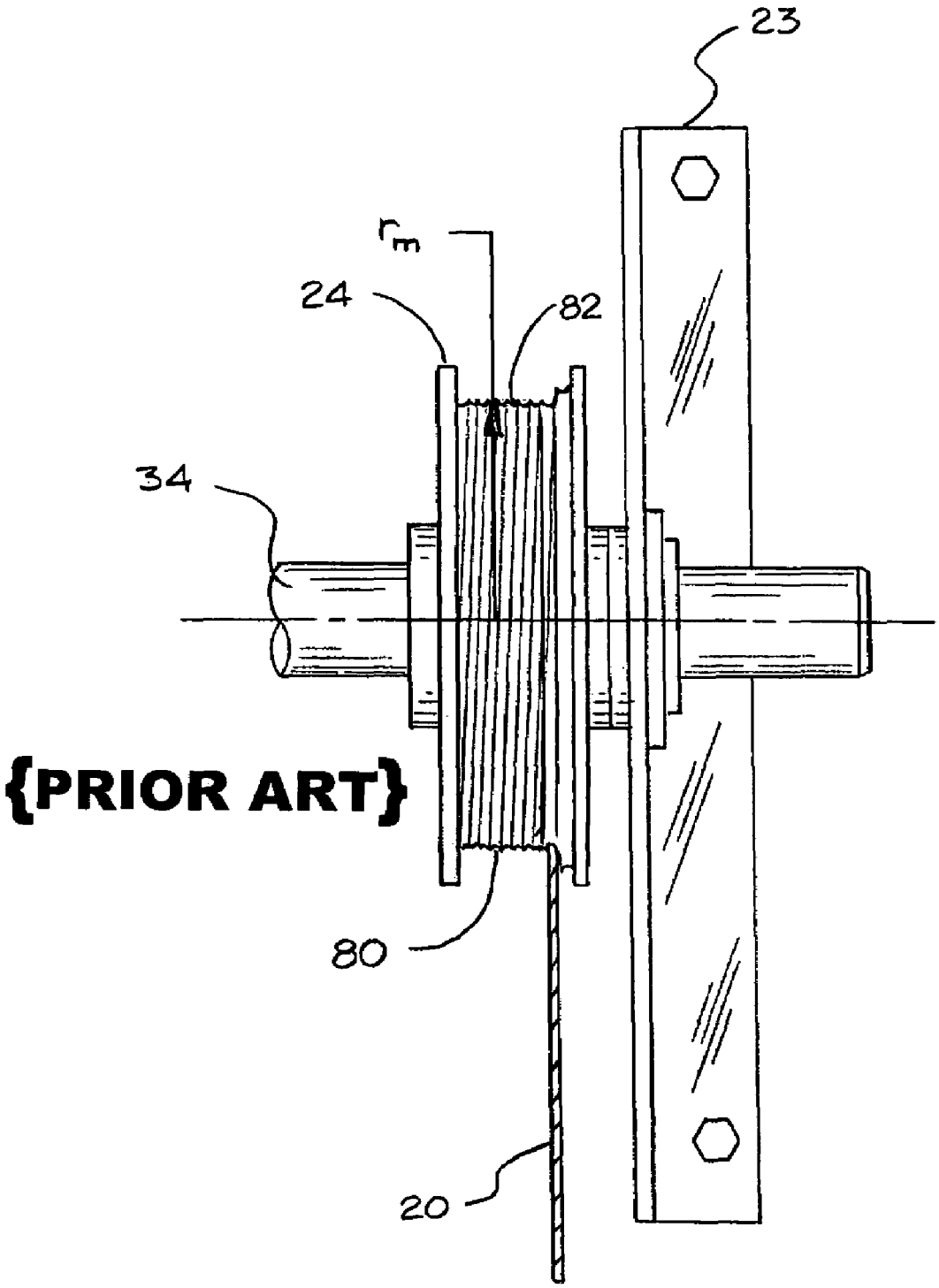
FIG. 3 is an elevation view of a conventional cable winding drum having a spiral-wound cable groove with a substantially constant minor radius.
Figure 4:
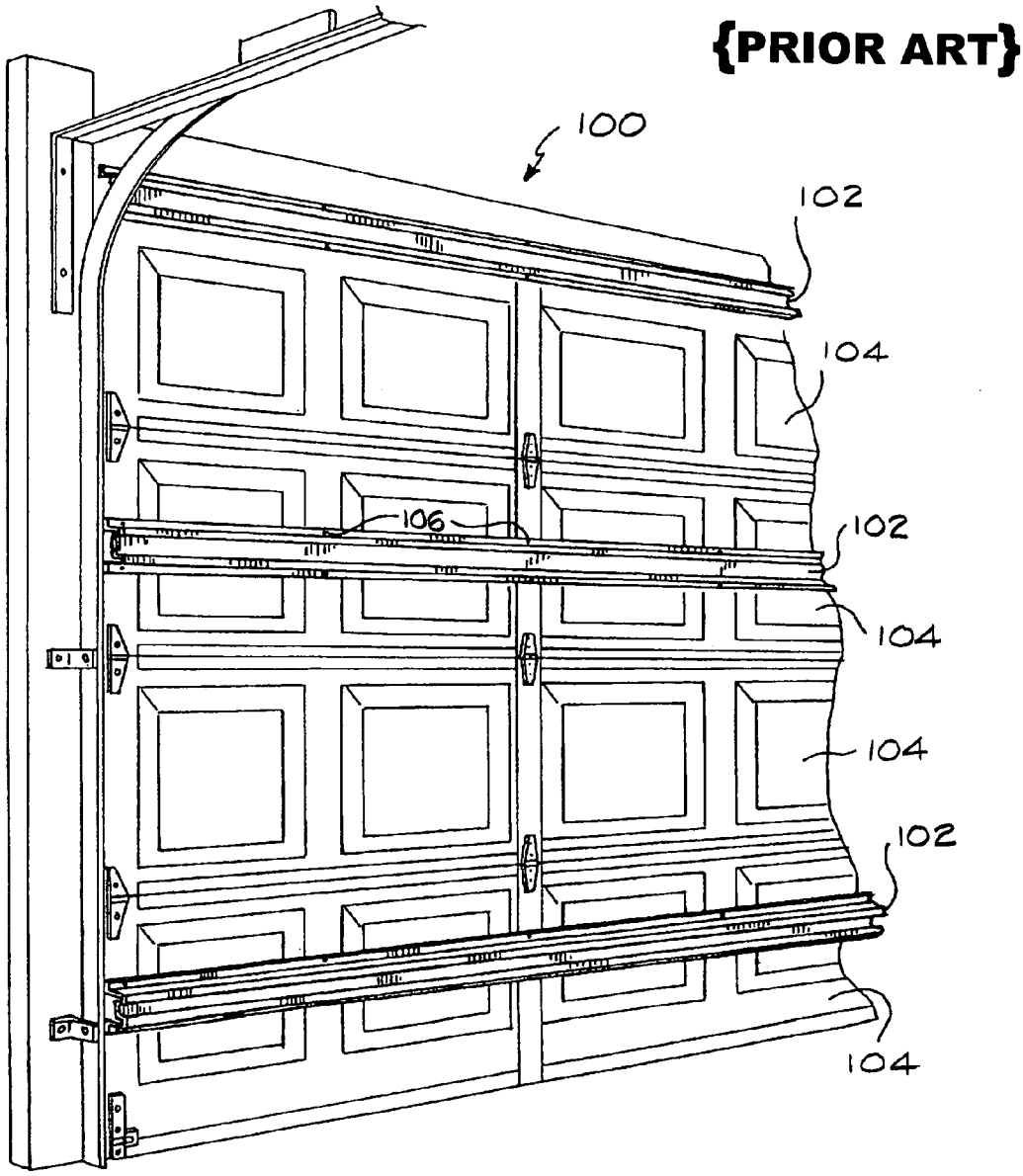
FIG. 4 is an inside perspective view of a portion of a sectional overhead door having a plurality of reinforcement struts.
Figure 5:
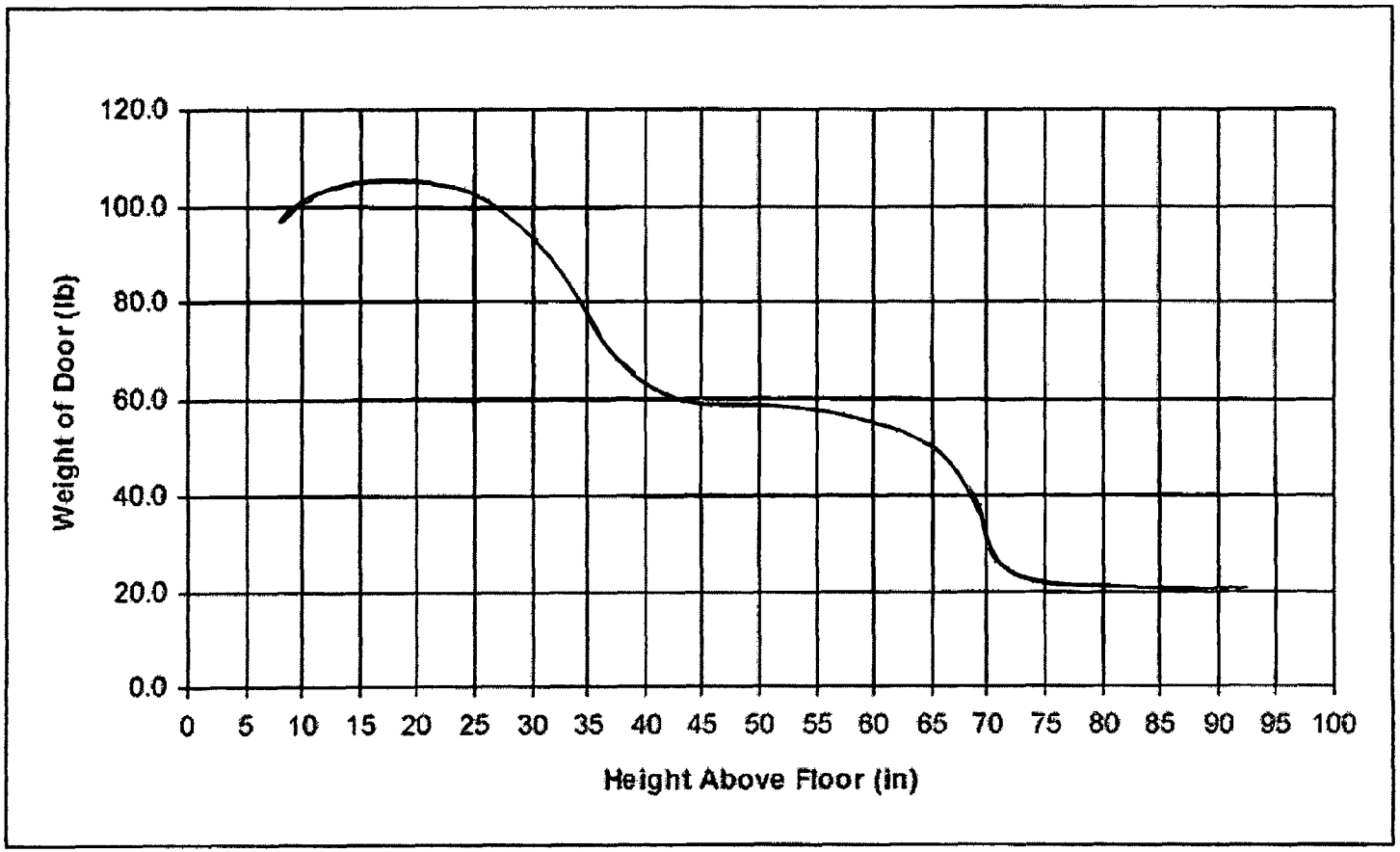
FIG. 5 is a graph showing a typical non-linear lift-weight to lift-height characteristic of a strut-reinforced sectional overhead door.

By matching the desired tensile load in the cable 220 with the non-linear weight-to-height characteristic of a particular door 210 (like that shown in FIG. 5), the desired minor radii at all points along the spiral groove 362 can be defined such that the lift system 300 is capable of applying a desired counterbalancing load to the door 310 at any point along the door's path between the open and closed positions. Accordingly, the door lift system 200 described above is capable of applying a variable lift force to a door such that the lift force is selectively increased and/or selectively decreased in a substantially non-linear manner as a door is raised or lowered to correspond to the instantaneous free-hanging weight of the door 310.

The above descriptions of embodiments of the invention are for the purpose of illustration only, and are not intended to limit the scope of the invention thereto. Persons of ordinary skill in the art will recognize that certain modifications can be made to the embodiments described above without departing from the invention. For example, although the embodiments of the door lift system and cable drum described above are described in association with a one or more coil torsion springs, other types of springs capable of applying variable torsional loads to a torsion bar also may be used. All such modifications are intended to be within the scope of the appended claims.

What is claimed is:

1. A counterbalance mechanism for a sectional overhead door of a type having a substantially non-linear lift-weight to lift-height ratio, wherein the mechanism comprises at least one substantially linear torsion spring and is capable of applying different counterbalancing lift forces to the door at different intermediate door positions between a fully closed position and a fully open position, wherein the difference between an intermediate lift weight of the door and a corresponding counterbalancing lift force at any intermediate door position is substantially constant, wherein the counterbalance mechanism further comprises at least one cable drum having a cable winding groove therearound having a first groove end corresponding to a first end of the drum and having a second groove end corresponding to a second end of the drum, wherein the winding groove has substantially continuously varying groove minor radii between the first and second groove ends, wherein the winding groove has a first minor radius at a first turn that is greater than a second minor radius at a second turn and is greater than a third minor radius at a third turn, and wherein the second turn is located between the first turn and the first end of the drum and the third turn is located between the first turn and the second end of the drum.

2. A counterbalance mechanism according to claim 1 wherein the cable drum comprises a central bore therethrough, the central bore being substantially concentric with a longitudinal axis of the cable drum.

3. A counterbalance mechanism according to claim 1 wherein the cable drum includes a first flange on the first end, the cable winding groove includes a first end turn proximate the flange, and wherein the flange includes a cable-receiving slot extending through the flange from a portion of the first end turn to the first end.

4. A counterbalance mechanism according to claim 1 and further including a hub outwardly extending from the second end of the cable drum.

5. A counterbalance mechanism according to claim 4 wherein the hub includes a hub wall having at least one set screw opening therethrough.

6. A counterbalance mechanism according to claim 1 and further including a flange on one end of the cable drum, and a hub outwardly and longitudinally extending from the flange.

7. A counterbalance mechanism according to claim 6 wherein the hub includes a hub wall having at least one set screw opening therethrough.

8. A counterbalance mechanism according to claim 1 wherein the cable winding groove includes a plurality of turns, and wherein no two full successive turns of the cable winding groove combine to form a substantially frustoconical portion of the cable drum.

9. A counterbalance mechanism according to claim 1 wherein the cable winding groove includes at least one full turn having a substantially non-circular shape.

* * * * *